US009631619B2

(12) United States Patent
Kourakos et al.

(10) Patent No.: US 9,631,619 B2
(45) Date of Patent: Apr. 25, 2017

(54) HELICAL ROTOR OF A PROGRESSING CAVITY PUMP

(71) Applicant: PCM, Levallois-Perret (FR)

(72) Inventors: Vasileios Kourakos, Angers (FR); Souleymane Ramde, Angers (FR)

(73) Assignee: PCM Technologies, Levallois-Perret (FR)

( * ) Notice: Subject to any disclaimer, the term of this patent is extended or adjusted under 35 U.S.C. 154(b) by 295 days.

(21) Appl. No.: 14/471,994

(22) Filed: Aug. 28, 2014

(65) Prior Publication Data

US 2015/0064037 A1 Mar. 5, 2015

(30) Foreign Application Priority Data

Aug. 30, 2013 (FR) ..... 13 58298

(51) Int. Cl.

| | |
|---|---|
| ***F01C 1/10*** | (2006.01) |
| ***F03C 2/00*** | (2006.01) |
| ***F03C 4/00*** | (2006.01) |
| ***F04C 2/00*** | (2006.01) |
| ***F04C 18/00*** | (2006.01) |
| ***F04C 2/107*** | (2006.01) |
| ***F04C 5/00*** | (2006.01) |
| ***F04C 18/107*** | (2006.01) |

(52) U.S. Cl.

CPC ..... *F04C 2/1073* (2013.01); *F04C 2/1071* (2013.01); *F04C 5/00* (2013.01); *F04C 18/1075* (2013.01); *F04C 2210/24* (2013.01); *F04C 2240/20* (2013.01)

(58) Field of Classification Search

CPC .. F04C 2/1071; F04C 2/1073; F04C 2240/20; F04C 2210/24; F04C 18/1075; F04C 5/00; F04C 29/0092

USPC ..... 418/47, 48, 152–153

See application file for complete search history.

(56) References Cited

U.S. PATENT DOCUMENTS

| | | | | |
|---|---|---|---|---|
| 2,512,764 | A | 6/1950 | Byram | |
| 6,382,930 | B1 * | 5/2002 | Bahnen | F04C 23/008 417/310 |
| 6,945,755 | B2 * | 9/2005 | Zupanick | F04C 2/1071 418/48 |
| 7,413,416 | B2 | 8/2008 | Bratu | |

FOREIGN PATENT DOCUMENTS

| | | |
|---|---|---|
| DE | 2316127 A1 | 10/1974 |
| EP | 1559913 A1 | 8/2005 |
| FR | 1367262 A | 7/1964 |

OTHER PUBLICATIONS

French National Institute of Industrial Property (INPI), French Preliminary Search Report issued in corresponding French Application No. FR1358298, Apr. 17, 2014.

* cited by examiner

*Primary Examiner* — Theresa Trieu

(74) *Attorney, Agent, or Firm* — Patzik, Frank & Samotny Ltd.

(57) ABSTRACT

A helical rotor intended to be arranged in a progressing cavity pump, said progressing cavity pump being capable of pumping a multiphase fluid from a fluid reserve, the helical rotor comprising at least one mixer capable of homogenizing the multiphase fluid located in said fluid reserve.

14 Claims, 3 Drawing Sheets

HELICAL ROTOR OF A PROGRESSING CAVITY PUMP

RELATED APPLICATIONS

This invention claims priority to French patent application No. FR 13/58298 filed Aug. 30, 2013, the entirety of which is hereby incorporated by reference.

FIELD OF THE INVENTION

The invention relates to a rotor for a progressing cavity pump, a progressing cavity pump comprising such a rotor and a pumping device comprising such a progressing cavity pump.

BACKGROUND OF THE INVENTION

A progressing cavity pump generally comprises a cylindrical armature, a stator arranged in the armature and having a helical inner shape, and a helical rotor arranged in said stator. Cavities, also known as cells, are delimited between the rotor and the stator. In operation, the rotor is made to rotate. The rotation of the rotor leads to the displacement or pumping of a fluid from one cavity to the cavity adjacent thereto, from one end of the pump, known as intake, to the opposite end, known as discharge.

During the pumping of a multi-phase fluid comprising a gaseous phase, a volume of gas taken in at the pump inlet is compressed progressively from intake to discharge. This compression leads to a significant increase in the temperature inside the pump, which damages the mechanical strength of the rotor and stator, for example by scorching of the elastomer forming the stator, and reduces the service life of a progressing cavity pump.

To overcome this drawback, patent application EP 1 559 913 proposes a progressing cavity pump comprising a rotor provided with channels connecting two or more cavities. During pumping, the pumped fluid circulates from one cavity to the next via these channels, thus ensuring that the pressure is balanced between the cavities connected to each other and thus reducing the temperature increase inside the stator.

SUMMARY OF THE INVENTION

The purpose of the present invention is to propose a rotor and a progressing cavity pump that more significantly reduce the compression of the gases and the resulting temperature increase.

To this end, the invention relates to a helical rotor intended to be arranged in a progressing cavity pump, said progressing cavity pump being capable of pumping a multiphase fluid from a fluid reserve, the helical rotor comprising at least one mixer capable of homogenizing the multiphase fluid located in said fluid reserve, said helical rotor comprising:

a first outer end face intended to be coupled to a drive shaft, a second free outer end face opposite to the first outer end face; and a helical outer face connecting the first outer end face to the second outer end face, and in which said mixer comprises an inner channel having at least one fluid ejection outlet located on the second outer end face, the inner channel being capable of ejecting a portion of said pumped multiphase fluid in said fluid reserve, to homogenize the multiphase fluid located in said fluid reserve, characterized in that said inner channel has at least one fluid inlet located on said helical outer face, and in that said fluid outlet is fitted with a restrictor capable of accelerating the ejection speed of said ejected portion of the fluid.

U.S. Pat. No. 2,512,764 describes a pump comprising a stator and a metal rotor. The metal rotor is provided with a central bore and a ball member screwed into a thread of the central bore. The ball member comprises radial and axial orifices that communicate with the central bore.

DE 23 16 127 describes a progressing cavity pump comprising a rotor provided with radial orifices into which a fluidizing liquid, for example oil, is injected, to lubricate the surfaces located between the rotor and the stator in order to reduce the wear of the stator.

However, said fluid outlet of the pumps described in U.S. Pat. No. 2,512,764 and DE 23 16 127 is not equipped with a restrictor capable of accelerating the ejection speed of said ejected portion of the fluid. Furthermore, the fluid inlets of these pumps are not located on an outer helical face of the rotor, but on an outer face of the ball member 26 that is fixed to the stator. Finally, the function of the radial orifices is not to homogenize the fluid located in the reserve. The function of the radial orifices and the central bore of the pump in U.S. Pat. No. 2,512,764 is to reinject the pumped water to facilitate the priming of the pump at the start of pumping. The function of the radial orifices in DE 23 16 127 is to lubricate the space between the rotor and the stator.

According to particular embodiments, the rotor comprises one or more of the following features:

in which said restrictor has a generally tapered shape.

in which said restrictor comprises a grille.

in which said restrictor comprises a fixed blade.

in which said restrictor comprises a mobile blade.

in which said restrictor is in the form of a honeycomb.

in which said helical rotor is a hollow tube.

in which said at least one fluid inlet is nozzle-shaped, having an opening with a larger diameter opening onto the helical outer face of the helical rotor.

in which said at least one fluid inlet has an elliptical shape.

in which a straight counterbore is made around said at least one fluid inlet on said helical outer face.

in which a tapered counterbore is made around said a least one fluid inlet on said helical outer face.

The invention further relates to a progressing cavity pump comprising an armature, a stator arranged in said armature, said stator having a helical inner shape, a helical rotor arranged in said stator, characterized in that said helical rotor has the above-mentioned features.

Preferably, the mixer comprises a portion that protrudes in relation to the stator.

Finally, the invention relates to a pumping device comprising a progressing cavity pump having an inlet and an outlet, a fluid reserve secured to the progressing cavity pump inlet, and a discharge pipe secured to the progressing cavity pump outlet, characterized in that the progressing cavity pump has the above-mentioned features and in that a grille is arranged across the fluid reserve; said grille has at its centre an oblong opening with dimensions enabling the helical rotor to pass through.

BRIEF DESCRIPTION OF THE DRAWINGS

The invention will be more clearly understood on reading the following description, given as an example only, with reference to the figures, in which:

FIG. 6A is a side elevation view of the helical rotor depicted in FIG. 6 showing a mobile blade;

DETAILED DESCRIPTION OF THE INVENTION

The helical rotor 2 according to the present invention is intended to be arranged in a progressing cavity pump capable of pumping a multiphase fluid from a fluid reserve.

Figure 1:
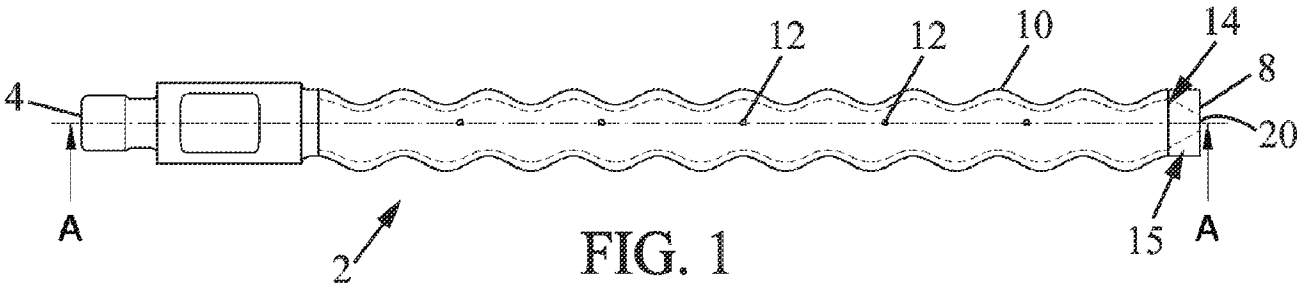
FIG. 1 is a side view of a helical rotor according to a first embodiment of the invention.
Figure 2:
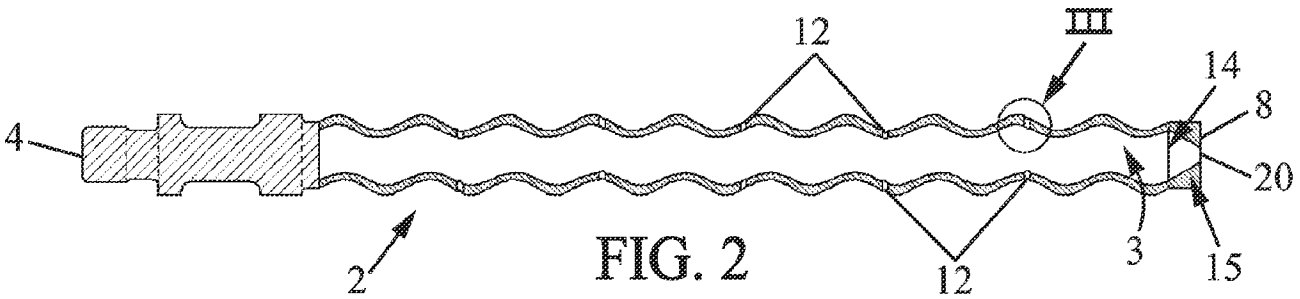
FIG. 2 is a cross-sectional view of the rotor shown in FIG. 1.
Figure 3:
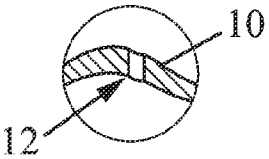
FIG. 3 is a cross-sectional view of a fluid inlet of the helical rotor shown in FIG. 1.

With reference to FIGS. 1 to 3, the helical rotor 2 according to the first embodiment of the invention is constituted by a hollow tube that comprises an inner channel 3. It is, for example, produced by hammering and/or bending of a metal or composite tube.

The helical rotor 2 also comprises a first outer end face 4 intended to be coupled to a drive shaft, a second outer end face 8 opposite to the first outer end face 4, and a helical outer face 10 connecting the first end face 4 to the second end face 8.

The helical outer face 10 comprises several through-holes, hereinafter referred to as fluid inlets 12, communicating with the inner channel 3. The second end face 8 comprises a through-hole, referred to as the fluid ejection outlet 14, likewise communicating with the inner channel 3 and the fluid inlets 12.

The channel 3, the fluid inlets 12 and the fluid ejection outlet 14 of the channel form a mixer according to the present invention. This mixer makes it possible to create a jet of fluid that is directed towards the progressing cavity pump inlet, as explained below with reference to FIGS. 6 to 8. This jet homogenizes the multiphase fluid located in a fluid reserve at the progressing cavity pump inlet by breaking the gas bubbles and clumps of earth or sand contained therein.

Thus, this fluid jet breaks down the clumps of earth and sand, dissolves the pockets of gas in the liquid and mixes the solids, liquids and gases. According to the inventors, if the mixture at the progressing cavity pump inlet is more homogeneous, localized scorching or separation of the stator elastomer is reduced. As the mixture is more homogeneous, it is compressed to the same compression level throughout.

The fluid inlets 12 have a circular shape, as shown in FIG. 3.

Figure 4:
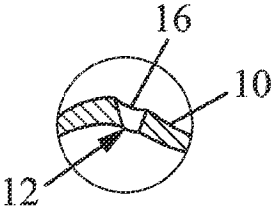
FIG. 4 is a cross-sectional view of a variant of the fluid inlet shown in FIG. 3.
Figure 5:
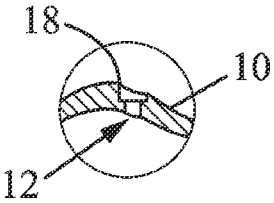
FIG. 5 is a cross-sectional view of a variant of the fluid inlet shown in FIG. 3.

In a variant, the fluid inlets 12 are nozzle-shaped, i.e. they are tapered, as shown in FIG. 4. In this case, the opening 16 of said tapered shape with the larger diameter is located on the helical outer face 10 of the rotor.

In a variant, the fluid inlets 12 have an elliptical shape.

In a variant, a straight counterbore 18 is made on said helical outer face 10 around the fluid inlets 12.

In a variant, a tapered counterbore 18 is made on said helical outer face 10 around the fluid inlets 12.

Advantageously, this tapered shape and the counterbore make it possible to increase the speed with which the fluid enters the inner channel 3.

According to the first embodiment shown in FIGS. 1 and 2, the fluid ejection outlet 14 comprises a restrictor 15 that will accelerate the ejection speed of the multiphase fluid coming out through the fluid ejection outlet 14. This restrictor 15 has a tapered shape, the opening 20 of which with the smaller diameter is located on the second end face 8.

Figure 6:
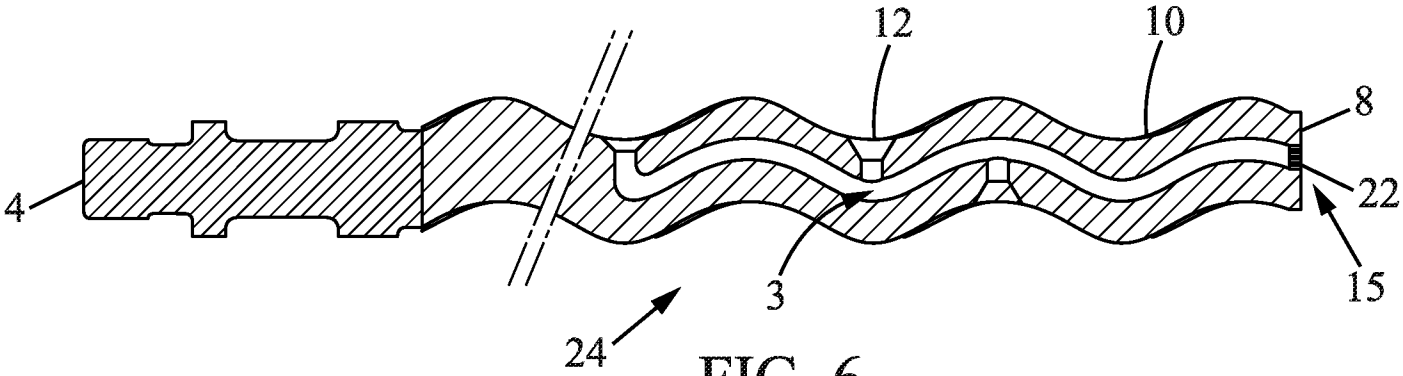
FIG. 6 is a cross-sectional view of a rotor according to a second embodiment of the invention.
Figure 6C:
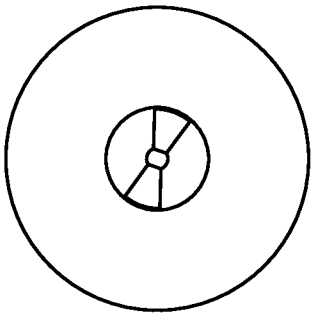
FIG. 6A is a side elevation view of the helical rotor depicted in FIG. 6 showing a fixed blade.
FIG. 6B is a side elevation view of the helical rotor depicted in FIG. 6 showing a honeycomb.

According to a first variant shown in FIG. 6, this restrictor 15 is constituted by a grille 22. According to a second variant shown in FIG. 6A, this restrictor 15 is constituted by a fixed blade capable of modifying the flow regime. According to a third variant shown in FIG. 6C, this restrictor 15 is constituted by a mobile blade. The speed of the fluid on intake makes it possible to drive the blade and modify the flow regime.

In the event of the rotor being used in a hydrocarbon, water or gas pumping installation, the blade replaces the positioning stop generally known as a tag bar.

Figure 6B:
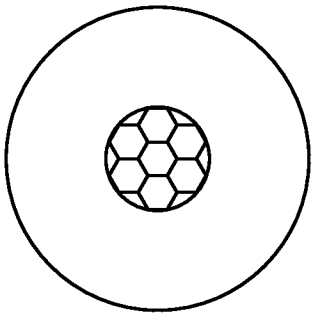
Figure 6A:
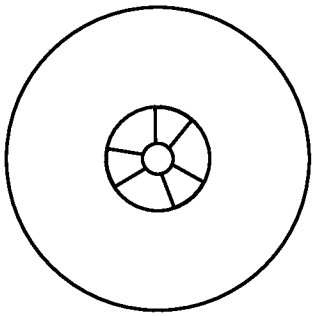

According to a fourth variant shown in FIG. 6B, this restrictor 15 is in the form of a honeycomb.

Alternatively, this restrictor 15 can comprise one or more of the above-mentioned variants. For example, this restrictor 15 can comprise both a tapered shape and a blade or grille.

Alternatively, the fluid ejection outlet 14 does not comprise a restrictor. In this case, the jet of multiphase fluid coming out of the fluid outlet 14 is not accelerated, but this jet nevertheless makes it possible to homogenize the multiphase fluid contained in the fluid reserve.

With reference to FIG. 6, the helical rotor 24 according to the second embodiment of the invention is constituted by a single piece made from a metal or composite material. The inner channel 3 is drilled inside this piece. The fluid inlets 12 communicate with the inner channel 3. Only an upper portion of the fluid inlets 12 is tapered. In the embodiment shown, the grille 22 is secured at the level of the fluid ejection outlet 14 to accelerate the ejection speed of the pumped multiphase fluid.

Figure 7:
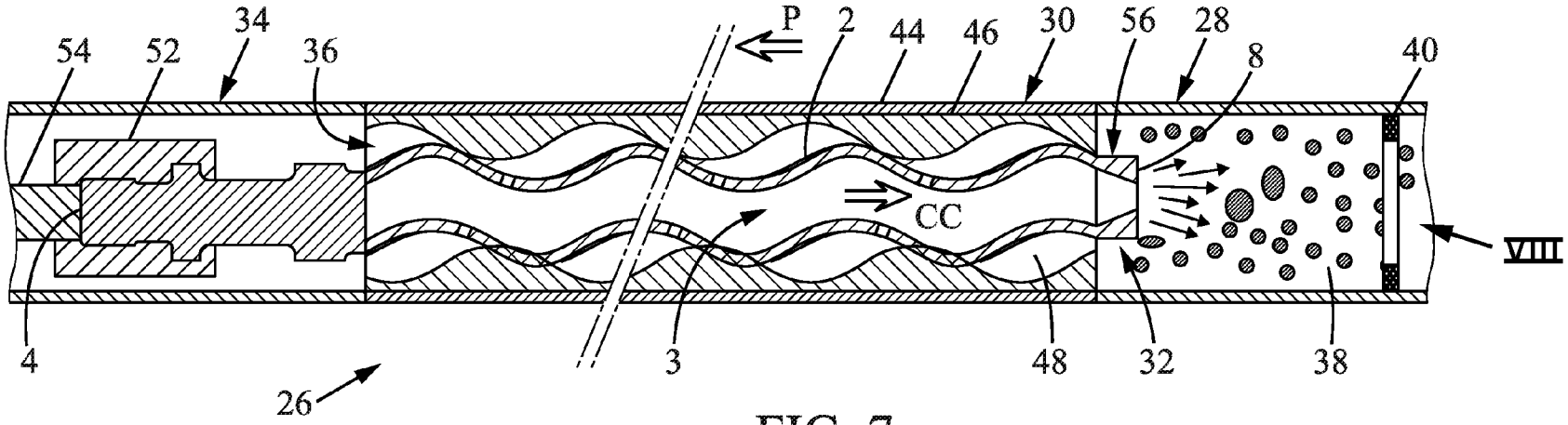
FIG. 7 is a cross-sectional view of a pumping device according to the invention.

The present invention also relates to a pumping device 26 shown in FIG. 7. This pumping device 26 comprises a pipe, referred to as the fluid reserve 28, a progressing cavity pump 30 having an inlet 32 secured to the fluid reserve 28 and a pipe, referred to as the discharge pipe 34, secured to an outlet 36 of the progressing cavity pump 30.

The fluid reserve 28 contains a multiphase fluid 38 to be pumped of the type comprising liquid and gases, or liquid and solids, or liquid, gases and solids. It is, for example, constituted by crude oil, pockets of gas, and clumps of sand.

Figure 8:
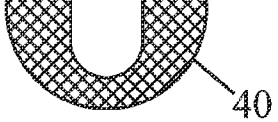
FIG. 8 is a front view of a grille arranged in the pumping device shown in FIG. 7.

A grille 40 is secured inside the fluid reserve 28, for example, by welding, riveting or screwing. This grille 40 is arranged across the flow area of the multiphase fluid. According to the present invention, this grille 40 constitutes an additional mixer that makes it possible to improve the action of the helical rotor 2 by performing a first operation of dissolving the gas pockets and clumps of sand. As shown in FIG. 8, this grille 40 comprises, at its centre, an oblong opening 42 through which the helical rotor 2 can pass when the helical rotor is being assembled in the progressing cavity pump 30. This grille 40 is, for example, secured a few tens of centimeters from the inlet 32 of the progressing cavity pump 30.

The progressing cavity pump 30 comprises a hollow cylindrical armature 44, a stator 46 arranged in the armature 44 and having a helical inner shape, a helical rotor 2 arranged in said stator 46 in such a way that cavities, generally referred to as cells 48, are defined between the helical rotor 2 and the stator 46.

The armature 44 can be made from a metal, polymer or composite material.

The stator 46 is made from an elastomer. According to a variant (not shown), the stator 46 is formed by a helical hollow cylinder. In this case, it is made from a metal having elastic properties, or a composite material having elastic properties.

The helical rotor 2 of this progressing cavity pump is identical to the helical rotor of the present invention shown in FIGS. 1 to 3. It will not be described again. The second end face 8 thereof is coupled, by a coupling component 52, to a drive shaft 54 driven in rotation by a motor, not shown.

According to the embodiment shown in FIG. 7, the helical rotor 2 has a length dimensioned so that when the helical rotor is arranged in the progressing cavity pump and is secured to the drive shaft 54, a portion 56 of the helical rotor extends outside the stator 46. According to the present invention, this portion 56 forms an additional mixer. When the helical rotor 2 is driven in rotation, this protruding portion 56 turns in the multiphase fluid 38, mixes it and thus allows the multiphase fluid 38 contained in the fluid reserve 28 to be homogenized.

During operation, when the helical rotor 2 is driven in rotation, the progressing cavity pump 30 pumps the multiphase fluid 38 from the inlet 32 towards the outlet 36 in a pumping direction P. The pumped multiphase fluid enters the channel 3, through the fluid inlets 12. It flows in the direction CC, in counter-current to the pumping direction P. It is ejected by the fluid outlet 14 on the side of the progressing cavity pump inlet 32 into the fluid reserve 28.

Advantageously, the extension of the length of the helical rotor 2 according to the present invention makes it possible to mix the multiphase fluid in the fluid reserve and the discharging of pumped multiphase fluid breaks the gas bubbles and clumps of earth or sand contained in the multiphase fluid located in the fluid reserve. As a result, the multiphase fluid pumped by the progressing cavity pump becomes more homogeneous.

Advantageously, if the fluid reserve 28 is not sealed, the inner channel 3 ejects a portion of the gases taken in by the progressing cavity pump into the fluid reserve 28.

According to another variant (not shown), the helical rotor 2 does not extend outside the stator 46, the action of homogenizing the multiphase fluid contained in the fluid reserve being performed solely by the ejection of a jet of fluid coming from the inner channel 3.

When the helical rotor 2 does not extend outside the stator 46, the helical rotor 2 can comprise an additional mixer. For example, the second end face 8 of the helical rotor 2 can be provided with a recess in which a retractable rod, a rod retraction control component and a rod release control component are arranged. According to this variant, when the helical rotor 2 is driven in rotation, the rod is extended outside the stator 46. The rod is rotated by the helical rotor 2 and mixes the multiphase fluid 38. On installation or dismantling of the progressing cavity pump, the rod is retracted into its recess.

According to the embodiment shown, the fluid inlets 12 are positioned all along the helical rotor 2. In a variant, the helical rotor comprises a larger number of fluid inlets 12 positioned between the middle of the length of the rotor and the outlet 36 of the rotor than between the middle of the length of the rotor and the inlet 32.

The first 4 and second 8 outer end faces are perpendicular to the longitudinal axis of the helical rotor. The first 4 and second 8 outer end faces are generally planar.

The invention claimed is:

1. A helical rotor of a progressing cavity pump, said progressing cavity pump pumping a multiphase fluid in a fluid reserve, said helical rotor comprising at least one mixer for homogenizing said multiphase fluid located in said fluid reserve, said helical rotor further comprising:

a first outer end face coupled to a drive shaft, a second free outer end face opposite to said first outer end face, and a helical outer face connecting said first outer end face to said second outer end face, and in which said mixer comprises an inner channel having at least one fluid ejection outlet located on the second outer end face, said inner channel adapted to eject a portion of said pumped multiphase fluid into said fluid reserve to homogenize the multiphase fluid located in said fluid reserve, wherein said inner channel has at least one fluid inlet located on said helical outer face, and wherein said fluid ejection outlet is fitted with a restrictor that accelerates the ejection speed of said ejected portion of said fluid.

2. The helical rotor according to claim 1, in which said restrictor has a generally tapered shape.

3. The helical rotor according to claim 1, in which said restrictor comprises a grille.

4. The helical rotor according to claim 1, in which said restrictor comprises a fixed blade.

5. The helical rotor according to claim 1, in which said restrictor comprises a mobile blade.

6. The helical rotor according to claim 1, in which said restrictor is in the form of a honeycomb.

7. The helical rotor according to claim 1, in which said helical rotor is a hollow tube.

8. The helical rotor according to claim 1, in which said at least one fluid inlet is nozzle-shaped, having an opening with a larger diameter opening onto the helical outer face of said helical rotor.

9. The helical rotor according to claim 1, in which said at least one fluid inlet is elliptical.

10. The helical rotor according to claim 1, in which a straight counterbore is made around said at least one fluid inlet on said helical outer face.

11. The helical rotor according to claim 1, in which a tapered counterbore is made around said at least one fluid inlet on said helical outer face.

12. A progressing cavity pump comprising:

an armature, a stator arranged in said armature, said stator having a helical inner shape, a helical rotor according to claim 1, arranged in said stator.

13. The progressing cavity pump according to claim 12, in which said mixer comprises a portion that protrudes in relation to said stator.

14. A pumping device comprising:

a progressing cavity pump according to claim 12, having an inlet and an outlet, a fluid reserve secured to said inlet of said progressing cavity pump, a discharge pipe secured to said outlet of said progressing cavity pump, and a grille arranged across said fluid reserve, said grille having at its centre an oblong opening with dimensions enabling said helical rotor to pass through it.

* * * * *